US005626044A

United States Patent [19]

Lara-Castro

[11] Patent Number: 5,626,044

[45] Date of Patent: May 6, 1997

[54] METHOD OF PRODUCING STEEL BARS FROM BILLETS

[76] Inventor: Manuel Lara-Castro, Ave. Fuentes del Valle 648 Ote., Col. Fuentes del Valle, San Pedro Garza García, Nuevo León, Mexico

[21] Appl. No.: 445,431

[22] Filed: May 19, 1995

[51] Int. Cl.[6] ..... B21B 1/12

[52] U.S. Cl. ..... 72/203; 72/365.2

[58] Field of Search ..... 72/203, 204, 252.5, 72/234, 365.2, 366.2

[56] References Cited

U.S. PATENT DOCUMENTS

| | | | |
|---|---|---|---|
| 1,977,285 | 10/1934 | McCleery . | |
| 4,193,283 | 3/1980 | Bowman et al. | 72/204 |
| 4,727,739 | 3/1988 | Piccotti | 72/203 |
| 5,284,042 | 2/1994 | Benedetti | 72/204 |

FOREIGN PATENT DOCUMENTS

| | | | |
|---|---|---|---|
| 2071545 | 3/1993 | Canada | 72/204 |
| 61-229402 | 10/1986 | Japan . | |
| 306 | 9/1910 | United Kingdom . | |
| WO93/08937 | 5/1993 | WIPO | 72/204 |

OTHER PUBLICATIONS

Nippon Steel Corporation Catalog No. PMD74, dated Apr. 1987 (and Mar. 1985) entitled: *Multi–Slit Rolling Technology for Steel Bar.*

*Primary Examiner*—Lowell A. Larson
*Assistant Examiner*—Thomas C. Schoeffler
*Attorney, Agent, or Firm*—A. Thomas S. Safford, Esq.

[57] ABSTRACT

A method and apparatus for producing steel bars wherein at least four individual bars are rolled at the same time from a single billet, thus increasing the production capacity of a given rolling mill operating at a predetermined velocity and designed to produce only one or two bars at the same time and without requiring tension relieving stations between the slitting box and the finishing rolling stands as in the prior art. The problems of uniform quality of final bars are solved by preforming the outermost elements of a multi-stranded stock with different shape and/or cross section as compared to the inner elements of said multi-stranded stock. An apparatus for separation of the individual elements of the multi-stranded bar is provided wherein the elements are separated at several stages starting with the two outermost elements in the first stage and continuing in the same order until the center elements are separated in the last stage. N/2 (rounded down to the next whole number) separation stages are provided for a multi-stranded sock with N elements (where N ranges from 4 to 8 as a practical matter). The capital and operational costs of a rolling mill incorporating the invention are consequently lowered.

2 Claims, 3 Drawing Sheets

4A
4B
4C
100
102
104
106
108
110
38
39

METHOD OF PRODUCING STEEL BARS FROM BILLETS

FIELD OF THE INVENTION

The present invention relates to a method of producing steel bars, more particularly steel reinforcing bars for concrete construction, whereby round bars are produced from steel billets, generally having a squared section, which are rolled in a sequence of passes through a multiple rolling stands mill wherein the cross section of the billet is gradually reduced and shaped until the final product is obtained.

The invention provides a method of rolling steel bars in such a manner that at least four individual bars are rolled at the same time from a single billet thus increasing the production capacity of typical existing rolling mills operating at a predetermined velocity and designed to produce only one or two bars at the same time. The invention allows the continuous rolling of billets into bars in the minimum number of passes and without requiring tension relieving stations between the slitting box and the finishing rolling stands as required generally in the prior art. The capital and operational costs of a rolling mill incorporating the invention are consequently lowered.

BACKGROUND OF THE INVENTION

The production of multiple sections from a single metal billet was proposed a long time ago as illustrated for example by British patent No. 306, dated Sep. 15, 1910, where a method of production of wire from sheets or strips of soft metals, e.g. lead alloys, tin or soft copper, subjecting said sheets to a rolling and pressing operation by which longitudinal parallel depressions or grooves are formed along the sheet. The individual sections can then be readily manually torn along such grooves or depressions. This early patent discloses a general concept of longitudinally dividing a metal piece into individual sections but was not addressed to the production of steel bars (which present other problems due to the hardness and very high rolling temperatures), nor does it foresee the problems solved by the present invention.

The production of steel bars and particularly rebars for concrete construction is very sensitive to manufacturing costs, because this product is produced massively at low profit margins. Manufacturers continually strive to bring down the operational and capital costs. Consequently, any improvement to the process or equipment which increases the output capacity of a given plant has great commercial value.

A proposal to produce several bars or sections from one billet is shown in U.S. Pat. No 1,977,285 to McCleery dated Oct. 16, 1934. This patent shows a method of rolling metal sections, such as angles, T's or channels in multiples of two or more units (with illustrations of up to eight units, see FIG. 10), all formed at the same time from a bar of a larger size. In the final pass, the sections are separated into individual units by means of rolls arranged to vertically shear and thereby cut or tear the thin web of metal joining the sections, whereby a plurality of units are simultaneously produced thus increasing the capacity of the mill. Although this patent suggests the general idea of preforming several units and then separating the individual units, it teaches to separate the sections by vertically offsetting the inner roll passes of adjacent sections. This patent does not deal with the problem of different tensional stresses between the inner and outer sections, because the sections are rolled following parallel paths without significant separation thereof in the horizontal direction.

Another proposal for simultaneously rolling multiple bars or channels is described in Japanese patent application 61-229402, which description is supplemented by the catalog No. PMD74 dated March 1985 and April 1987 by Nippon Steel Corporation. FIG. 3 of the patent application for example shows a schematic rolling mill for round sections having a rolling process progression as illustrated by FIG. 4. The rolling process starts with a billet (1*a*), which is pressed to a flat form (1*b*) in rolling stand 3, subsequently preformed in stand 5 to the form (1*d*) and then separated longitudinally into four separate sections (1*e*) in rolling stand 6. It can be seen that the separation of the individual sections is performed by the rolls of stand 6 which is different to the present invention. A better view of the separating rolls is seen on page 2 of the above identified catalog. The main difference between this prior art and the present invention is that the Japanese patent relies only on the rolls with a special shearing and cutting profile to separate the individual sections and not on any other special slitting and splitting devices (see page 1 of the catalog). This patent has the disadvantage that the cutting rolls are more expensive and subject to wearing of the cutting surfaces implying higher operational and maintenance costs.

U.S. Pat. No. 4,193,283 to Bowman et al., dated Mar. 18, 1980 discloses a method and apparatus for slitting billets of metal which are rolled to produce a double or triple stranded bar. The method comprises slitting a multi-stranded bar of "no more than three strands", wherein each strand is longitudinally interconnected to the adjacent strand and is divided into individual sections by diverging the two outer strands. This patent however is expressly limited to only three strands. Although this patent teaches that more than three strands could be handled, it does not teach or suggest to produce a multi-stranded bar of four or more strands, but rather suggests only to apply more than once the same three strand technique in a single mill train. In other words, by applying the invention of this patent a billet would be divided in a first stage into three sections and then each section would be divided in a second stage into three smaller sections, etc. (requiring a much longer line with a greater number of stands). In contrast, the present invention allows production of four or more strands all rolled at the same time (and thus in a shorter distance, a significant capital and operational saving). This patent teaches that preferably all strands are of "the same cross-sectional size and shape." But, if different, then it suggests that the outer strands be identical in shape while the central strand may be different "provided that the percentage reduction in stand C, the slitting stand, is substantially equal for all strands." This patent, being limited to three strands, is mute in respect to a four strand roller and to the preferred shape given to the outer strands, particularly where a uniform product is desired. Thus, one of ordinary skill in the art would not look to this patent for any teaching in how simultaneously to produce more than three separate strands of uniform re-bar.

U.S. Pat. No. 5,284,042 to G. Benedetti, dated Feb. 8, 1994 discloses a method to obtain simultaneously in the cold state a plurality of sections and/or bars, starting with a hot-rolled single multiple-section element, which is then cooled off-line, sheared into final lengths, and then undergoes (assertedly without a break in continuity, but actually in a separate return line, see FIG. 4) an operation in the cold state of simultaneous lengthwise splitting to separate the individual small sections or bars. This patent teaches to cool down the webbed multiple section element before its separation (which operation adds complexity to the bars' manufacture, since the separation is more easily and smoothly done while the steel element is at high temperature). This patent, like all others discussed above, does not teach nor suggest to form the sections having a different cross sectional shape so as to avoid underfilling the roller profile in the subsequent passes of the rolling mill.

OBJECTS AND SUMMARY OF THE INVENTION

It is therefore an object of the invention to provide a method of producing steel reinforcing bars from steel billets which simultaneously rolls more than three individual elements obtained from a single common billet to the final shape of the bar product, from ¾ inches and smaller (¼ inch rebar being currently about the smallest marketable size), while at high temperature suitable for the rolling operation.

According to the present invention the objects thereof are achieved by providing a method and an apparatus for rolling a steel billet into steel reinforcing bar product in a continuous hot rolling mill comprising a plurality of rolling stands, which method comprises forming a multiple element stock of at least four elements by rolling a billet in a plurality of stands whereby said individual elements are lengthwise joined together by a web of steel, and wherein the successively outer-most pair elements have a different shape and/or cross section as compared to the next inner elements in said multiple element stock, splitting said individual elements while still at a high temperature and before the final shape of said bars is simultaneously formed thereon, and simultaneously rolling said individual elements to the final shape of said product bars.

An apparatus is provided according to the invention for separating in the hot state individual elements along grooves of a preformed multi-stranded stock, said elements being joined together by thin steel webs along said grooves, comprising a frame, a plurality of circular separating members having a beveled periphery on both sides of said circular members defining a wedge shaped profile which forces the elements to be split when said circular members guide the adjacent elements along its sides without cutting said joining webs but forces them to be torn apart. A first pair of said circular members are rotatably located on a first shaft mounted on said frame aligned with the outermost grooves of said multi-stranded stock, and define a guiding space between said circular members to guide the remaining elements of said stock still joined and which will be separated by subsequent circular members. A similar pair of circular members located on a second shaft are rotatably mounted on said frame and below said first shaft so that said circular members on said first shaft cooperate with those circular members of said second shaft and force said outermost elements to be separated along the outermost grooves. Third and fourth shafts have corresponding circular separating members and are located downstream in the direction of processing of said multi-stranded stock. Said fourth shaft is located below said third shaft and cooperates with said third shaft in the same manner as said first and second shaft to separate the outermost elements of the remaining multi-stranded stock; and so on until the number of pairs of shafts sum N/2 and the number of pairs of circular elements sum N−1 for a multi-stranded stock of N elements.

BRIEF DESCRIPTION OF THE DRAWINGS

In this specification and in the accompanying drawings, some preferred embodiments of the invention are shown and described and various alternatives and modifications thereof have been suggested; but it is to be understood that these changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF THE INVENTION

The invention is hereinafter described relative to a preferred embodiment as applied to a four strand rolling of billets to produce steel reinforcing bars, but it will be understood that it can be adapted to other types of products and to any number of simultaneously rolled strands more than three, where the first roll after the splitting of the individual elements formed from a single common slitted billed causes that the outer elements be subjected to a different stress than the inner elements being rolled due to the different horizontal distances run by said inner and outer elements.

Figure 1:
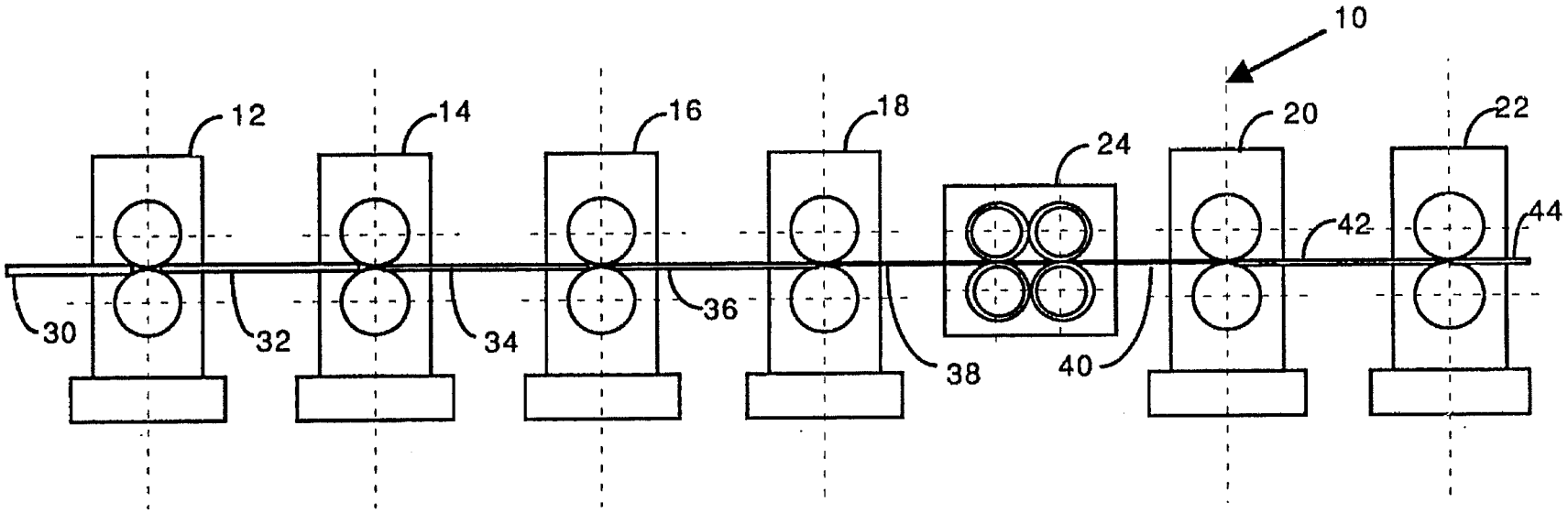
FIG. 1 schematically shows a rolling mill in elevation view with rolling stands and a slitting guide to separate four strands from an initial square billet.
Figure 2:
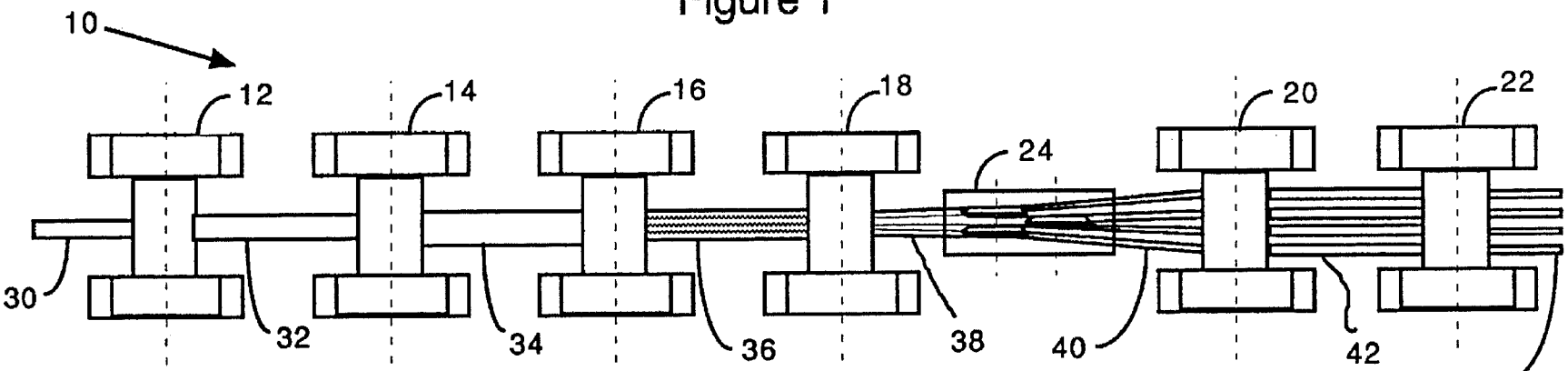
FIG. 2 is a schematic plan view of the rolling mill of FIG. 1 showing the separation and simultaneous finishing of four bars.
Figure 3:
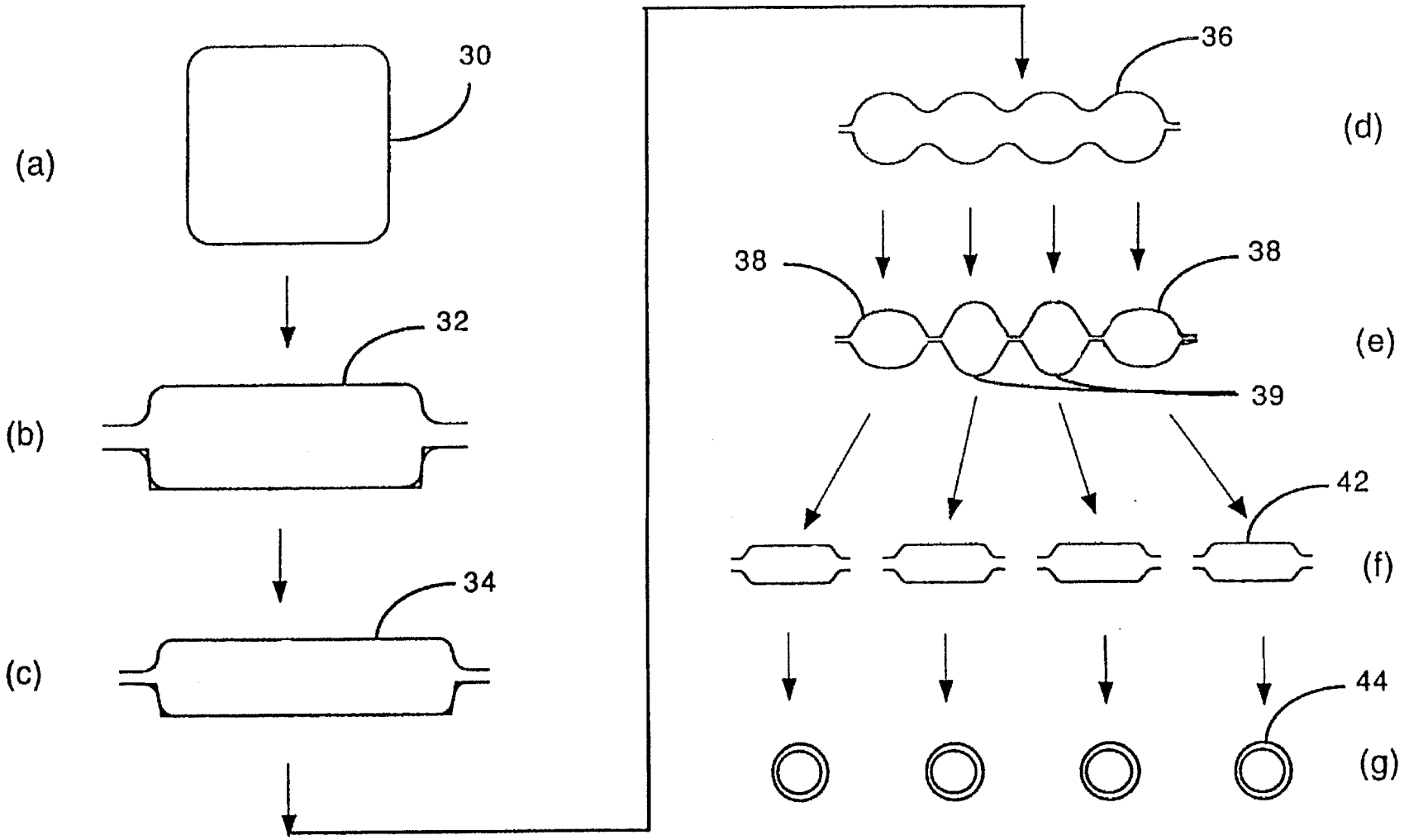
FIG. 3 shows a specific pass design for one of the products and which illustrates the successive shapes given to the initial square billet until four bars are simultaneously produced.

With reference to FIGS. 1, 2 and 3, numeral 10 generally designates a rolling mill which comprises a plurality of rolling stands 12, 14, 16, 18, 20, and 22, (only the minimum number required for producing corrugated reinforcing bars of 0.5 inches diameter is shown here). Rolling stands comprise at least two rolls with the specifically designed grooves so as to compress and form the hot still-plastic steel billet into the ultimate desired shape, accomplished by a gradual reduction in cross section until it is given the final shape and size at the last stand. The initial square billet 30 is rolled into a first rectangular "flat box" form 32 at rolling stand 12, and then to a flatter profile 34 at rolling stand 14. It will be evident to those of ordinary skill in the art, being familiar with the pass design techniques, that the number of successive passes and the number of rolling stands needed to obtain a flat profile, adapted to be slitted into multiple elements, will vary from plant to plant, according to the shape and size of both the initial feedstock and of the final product, taking into account the limitations imposed by the allowable gradual reduction of cross section of the billet in each pass.

The flat profile 34 is then preformed into a grooved form 36 at rolling stand 16 in preparation for a slitting pass at stand 18 wherein the material is fully slit into four separate individual strands comprising two outer elements 38 and two inner elements 39. Since the four elements are separated, torn apart, in the splitting box 24 which is more fully described in FIG. 4, the attendant horizontal separation of the individual elements necessarily results in the outer elements being subjected to higher tension and thus elongation due to greater distance traveled in the horizontal direction than the inner elements. In other words, if the four elements when formed in the splitting box 24 are initially strands of identical cross section, upon arriving simultaneously at the next rolling stand 20 the outer elements 38 will have had to travel a greater distance including a horizontally perpendicular vector in addition to the longitudinal distance (relative to the inner elements 39) and thus necessarily be elongated resulting in a relatively more narrowed cross-section. This physically and dynamically creates a problem of underfilling the apertures formed by the grooves in the subsequent rollers for the two outer elements 38 (when the four elements 38 and 39 are formed initially of identical shape and cross section, as is the case in all the pertinent prior art known to applicant). With the outer roller grooves corresponding to elements 38 in the next rolling stand 20 being underfilled, the shape of the resulting outer elements 42 will not be uniform relative to the inner elements and will produce a bad quality and nonuniform product. The present invention solves this problem by giving a different shape and/or cross section to outer elements 38 as compared to the inner elements 39 (seen best in a preferred example in FIG. 3 by comparing the shape and size of elements 38 relative to elements 39). To achieve a uniform product from all four strands 44 in FIG. 3(*g*), the cross-sectional profile shown for the intermediate pair 18 just before splitter 24 preferably has the shape shown in FIG. 3(*e*). To counter both the different dynamic forces acting on the each pair set of relatively outer strands feeding to the respective outer roller grooves and the change in cross-section due to elongation acting on such relatively outer strands, the latter relatively outer strands are preferably given both an initially larger cross-sectional shape and a larger horizontal major axis relative to the respective next adjacent inner strand(s), when at the processing position illustrated in FIG. 3(*e*). Preferably the significance in cross-sectional area of the outer strands relative to the smaller inner strands when measured in the shape shown in FIG. 3(*e*) ranges from 0.5% to 2% larger.

No prior art known to applicant teaches the concept of giving a different shape to the multiple elements 38 and 39 in order to allow for the greater stretch horizontally of the material in elements 39, so that there is more material to be elongated and in this way counteract the greater longitudinal tension in the outer elements.

Although it is known that the number of passes and the design of each pass can vary according to each situation and anyway obtain the same product, the characteristic feature of the invention is that the shape and/or cross section of the outer elements is wider in the horizontal direction than in the vertical direction, as shown in FIG. 3. The shape of the inner elements can take any suitable form according to the requirements of the process.

Figures 4A, 4B, 4C:
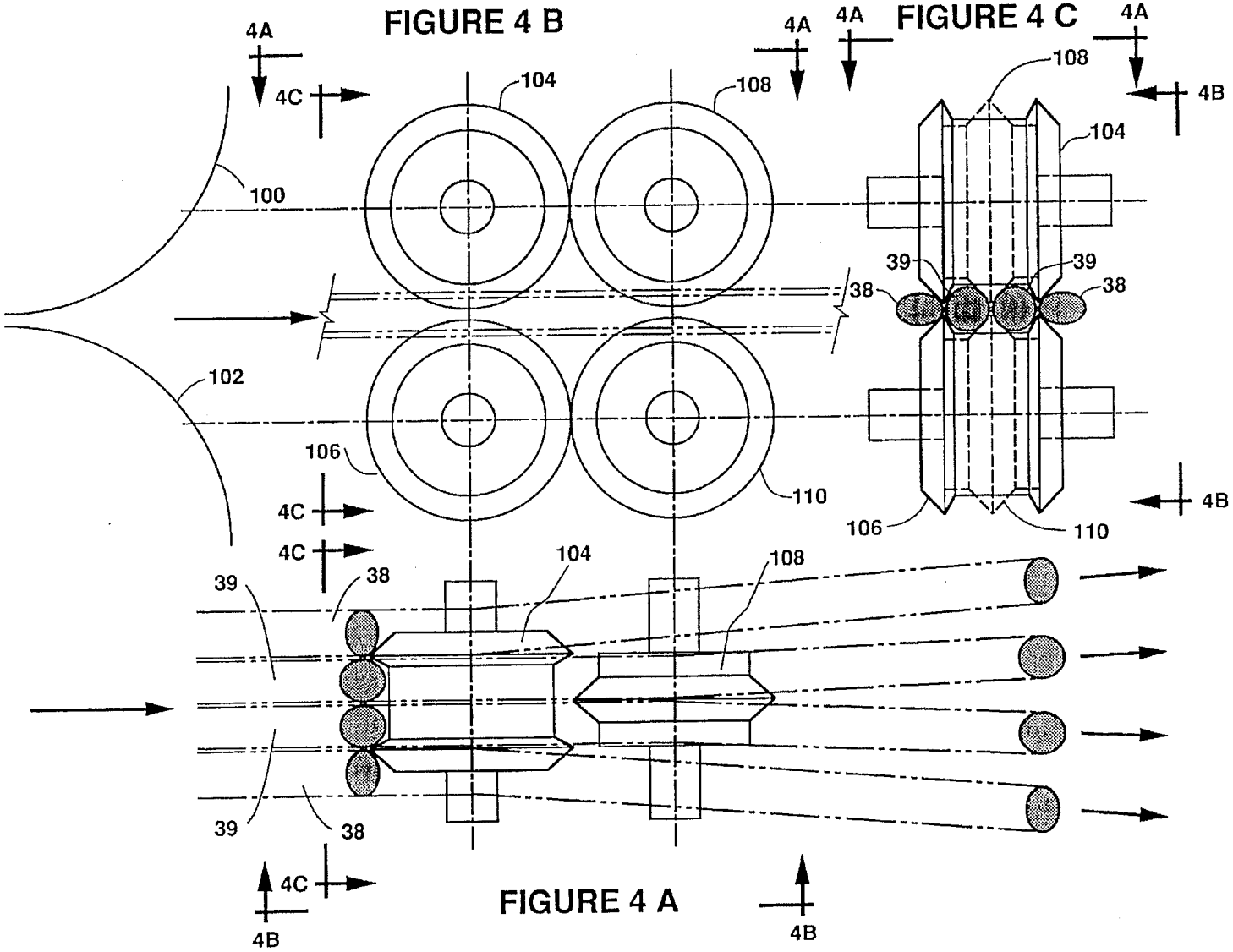
FIGS. 4A, 4B and 4C show similar schematic diagrams of one embodiment of the slitting guide and separation rolls useful for separation of the individual elements which are formed from a single common billet and which are subsequently formed into individual bars product; with FIG. 4A being a plan view (with the vertical sectional shape of the individual bar elements being shown superimposed it the dash-dot outline of such elements both before and after passing through the slitting guide and separation rolls) as though viewed in the direction indicated by the arrows perpendicular to line 4A—4A in FIGS. 4B and 4C; and with FIG. 4B being a side elevational view in the direction of the arrows perpendicular to line 4B—4B in FIGS. 4A and 4C; and with FIG. 4C being an end elevational view in the direction of the arrows perpendicular to line 4C—4C in FIGS. 4A and 4B.

Separation of the individual elements subsequently formed into individual bars product in the stands 20 and 22 is carried out by means of the splitting box with separation rolls 104, 106, 108 and 110, shown in more detail in FIG. 4. The box comprises a first pair of separation circular members or rolls 104 and 106, each having dual beveled periphery on both sides of each such circular members defining a wedge shaped profile, and which forces the elements to be split when said circular members guide the adjacent elements along its sides without cutting said joining webs but forces them to be torn apart, thus separating first the outer elements 38 from the respective adjacent element 39. The circular members 104 define a guiding space between said circular members to guide the remaining two still-joined elements 39 of said stock (and which will be separated by subsequent circular members 108 and 110).

A second pair of separation rolls 108 and 110 divides the dual element feedstock 38 along the center groove.

Similarly, in the case of multi-stranded stocks of for example six (6) elements, a third pair of shafts having corresponding circular separating members separates the joined elements of the remaining multi-stranded stock, and so on until the number of pairs of shafts sum N/2 (rounded down to the next whole number) and the number of pairs of circular elements sum N−1 for a multi-stranded stock of N elements where N ranges from 4 to 8 (as a practical matter).

It is to be noted that the separation of the individual elements occurs by tearing apart said adjacent elements and not by cutting the steel web joining them. This feature makes the separation rolls very reliable and minimizes the maintenance costs and operational costs of this device.

The problem with splitting boxes of the prior art which have not been successful in separating rolled stock of four or more elements is that the obvious way of designing the separation rolls is to increase the number of separating rolls in the same shaft and to separate all the elements simultaneously. This arrangement however causes many problems in handling the four elements simultaneously. This invention on the other hand performs the separation in several stages. In this way, the space between the separation rolls of the same shaft is used as a guide for the remaining elements still joined together, and only the outermost elements are separated at a given time. For example, when the rolled stock comprises four elements, there are two pairs of opposed separation rolls but the first pair carries out the separation of the outer elements only and then the second pair separates the inner elements. In the case of splitting a rolled stock having six elements the number of pairs of opposed separation rolls is three. The first pair separates the outermost elements and the next pair of rolls separates the outer elements of the profile remaining joined after the separation of the outermost elements and then a third pair of separation rolls separates the last two elements formed in the middle portion of the slitted profile. In the case of rolling five elements, there would be only two shafts, but the second shaft would have a pair of rollers with dual circular cutter elements (instead of only one, as in the case of a four element setup).

From the foregoing description it should be apparent that the present invention provides a process capable of achieving the several objects of the invention set forth above. It is of course to be understood that the foregoing description is intended to be illustrative only and that numerous changes can be made in the structure of the system described and its operating conditions without departing from the spirit of the invention as defined in the appended claims. The invention can be applicable to other type of steel products and to rolling mills where the production capacity is easily increased by simultaneously slitting and rolling four or more strands instead of only one, two or three strands.

What is claimed is:

1. A method of rolling a steel billet into uniform steel reinforcing bar product in a continuous hot rolling mill having a plurality of rolling stands, which method comprises forming a multiple element rolled stock composed of at least four individual strand-like side-by-side elements by rolling a billet through a plurality of successive stands, said individual elements of said rolled stock being joined together lengthwise to the next adjacent element(s) by a thin web of steel therebetween, outer elements have a different shape and a larger cross-section as compared to the next respective inner elements in said multiple element stock, splitting said individual elements while at a high temperature to separate horizontally all the strand-like elements in a single pass, and thereafter simultaneously rolling said separate individual elements to a final shape of said product bars, whereby said difference in shape of the inner and outer elements counteracts differences in tension and produces individual reinforcing bars of uniform size and shape.

2. A method of rolling a steel billet to steel reinforcing bar product according to claim 1 wherein said shape of the outer elements is wider in a horizontal direction than in a vertical direction.

* * * * *